US011572226B2

(12) United States Patent
Yacko et al.

(10) Patent No.: US 11,572,226 B2
(45) Date of Patent: Feb. 7, 2023

(54) CONCENTRATE CARTRIDGE WITH MEMBRANE

(71) Applicant: iDispense, LLC, Toledo, OH (US)

(72) Inventors: R. Bruce Yacko, Toledo, OH (US); Christopher J. Yacko, Toledo, OH (US); Martin Sikula, Toledo, OH (US)

(73) Assignee: IDISPENSE, LLC, Toledo, OH (US)

( * ) Notice: Subject to any disclaimer, the term of this patent is extended or adjusted under 35 U.S.C. 154(b) by 0 days.

(21) Appl. No.: 17/405,467

(22) Filed: Aug. 18, 2021

(65) Prior Publication Data

US 2022/0055818 A1 Feb. 24, 2022

Related U.S. Application Data

(60) Provisional application No. 63/067,677, filed on Aug. 19, 2020.

(51) Int. Cl.

| | |
|---|---|
| ***B65D 81/32*** | (2006.01) |
| ***B05B 11/00*** | (2006.01) |
| ***B65D 51/28*** | (2006.01) |

(52) U.S. Cl.

CPC ..... *B65D 81/3283* (2013.01); *B05B 11/0054* (2013.01); *B05B 11/0081* (2013.01); *B65D 51/2864* (2013.01); *B65D 81/3205* (2013.01)

(58) Field of Classification Search

CPC ..... B05B 11/0008; B05B 11/0078; B05B 11/0083; B65D 81/32; B65D 81/3283; B65D 81/3205; B65D 51/2807; B65D 51/2864

USPC ..... 222/83.5

See application file for complete search history.

(56) References Cited

U.S. PATENT DOCUMENTS

| | | | | |
|---|---|---|---|---|
| 2,653,611 | A | 9/1953 | Smith | |
| 3,024,947 | A | 3/1962 | Jaynes, Jr. | |
| 3,347,410 | A | 10/1967 | Schwartzman | |
| 3,655,096 | A | 4/1972 | Easter | |
| 5,871,122 | A * | 2/1999 | Klima | B05B 11/0086 222/130 |
| 5,957,335 | A | 9/1999 | Otto | |
| 6,041,969 | A | 3/2000 | Parise | |
| 6,290,100 | B1 | 9/2001 | Yacko et al. | |
| 6,305,576 | B1 * | 10/2001 | Leoncavallo | B65D 51/2814 222/88 |
| 8,794,474 | B2 * | 8/2014 | Mueller | B05B 11/0081 215/44 |
| 11,260,409 | B2 * | 3/2022 | Ribeiro | B65D 81/32 |
| 2021/0253303 | A1 * | 8/2021 | Bartolucci | B65D 1/0207 |

* cited by examiner

*Primary Examiner* — Vishal Pancholi
*Assistant Examiner* — Robert K Nichols, II
(74) *Attorney, Agent, or Firm* — Shumaker, Loop & Kendrick, LLP; James D. Miller

(57) ABSTRACT

A concentrate cartridge comprising includes a hollow cylindrical element having a chamber formed therein. The Chamber is configured to receive a concentrate material therein. The hollow cylindrical element has an upper end and a lower open end. A seal is configured to seal the lower open end of the hollow cylindrical element. A cap is configured to be received on the lower open end of the hollow cylindrical element.

17 Claims, 4 Drawing Sheets

CONCENTRATE CARTRIDGE WITH MEMBRANE

CROSS-REFERENCE TO RELATED APPLICATIONS

This application claims the benefit of U.S. Provisional Application No. 63/067,677, filed on Aug. 19, 2020. The entire disclosure of the above application is hereby incorporated herein by reference.

FIELD OF THE INVENTION

The invention relates to a concentrate cartridge for a diluting and dispensing container for combining a concentrated material, typically a liquid, with a liquid diluent, such as water, that are combined before use and subsequently dispensed together as a solution.

BACKGROUND OF THE INVENTION

It is often desirable to retain components of a multi-component system separate and to combine them shortly before use. This is true of systems wherein the components are incompatible either with each other as well as when it is desired to supply the consumer with a concentrated substance which can be diluted, typically with water, to form a solution.

Presently there are available dispensing containers for multi-constituent systems, which are designed to receive reusable concentrate containing cartridges. The concentrate material is supplied in a separately packaged cartridge that is inserted into the neck of a reusable diluting and dispensing container.

One such cartridge is described in U.S. Pat. No. 6,290,100 to Yacko et al. entitled Concentrate Cartridge for a Diluting and Dispensing Container, incorporated herein by reference in its entirety.

The concentrate cartridge disclosed in the '100 patent includes a hollow cylindrical element having a first open end forming a closure seat and a second end including a flange extending radially outwardly from the cylindrical element, and a hollow tube having a first end portion in a substantially fluid tight sliding relation with the second end of the cylindrical element and a second end terminating in a radially outwardly extending closure adapted to selectively seat with the closure seat of the hollow cylindrical element to form a fluid tight seal therebetween.

The radially outwardly extending closure is opened in response to a downward force applied to the first end portion of the hollow tube, wherein the closure element is caused to unseat from the closure seat of the cylindrical element. The hollow cylindrical body of the cartridge is held in place in the dispensing container wherein the lower surface of the radially outwardly extending flange of the cartridge is supported on an upper land portion of the neck of the container.

A closure cap is utilized to apply axial force to urge the hollow tube downwardly until the closure is opened allowing the concentrated material to be released from the cartridge into the interior of the container. Simultaneously, the downward force of the closure cap effects a sealing relationship between the undersurface of the flange of the cartridge and the upper land surface of the neck of the container.

The resulting mixture of the constituents, the concentrated material in the cartridge and the dilutent in the container, is dispensed from the container through a dip tube and a dispensing orifice as a spray or a stream of liquid in response to activation of a hand-pump associated with the closure cap.

Dispensers for combining the components of a multi-component system shortly before use can be classified into three distinct groups. The first group are those employing reusable containers that can be recharged with a fresh cartridge of concentrate when the solution is expended; a second group wherein the container and cartridge of concentrate are designed for a single use and subsequent disposal; and a third group wherein the cartridge for the concentrate may be refilled with concentrate after being used to produce a diluted operative solution. In the second group, the cartridge of concentrate is typically permanently contained within the container and/or dispenser.

Representative of the first class of container-dispensers is the device disclosed in the U.S. Pat. No. 3,655,096 to Easter, the disclosure of which is hereby incorporated herein by reference in its entirety. The patent describes a dispensing system employing a replaceable cartridge containing a concentrated liquid material in combination with a bottle and a dispensing pump device. The cartridge has frangible upper and lower surfaces and an annular flange extending from the upper surface. The cartridge is placed in the neck of the bottle and supported by the annular flange resting on the rim of the container neck. The dip tube passes through the cartridge by puncturing both its top and bottom surfaces. The concentrate will drain into and mix with a diluent, such as water. The resulting solution is dispensed by activating the pump mechanism to upwardly draw the solution through the dip tube and to expel it from a dispensing orifice in the pump head.

The second class of multicomponent container dispensers includes the devices disclosed in the U.S. Pat. No. 3,024,947 to Jeynes Jr., U.S. Pat. No. 2,653,611 to Smith and U.S. Pat. No. 3,347,410 to Schwartzman, the entire disclosures of which are hereby incorporated herein by reference. The Jeynes Jr. patent discloses a squeeze bottle of the foregoing type wherein the concentrated material is present in a ring shaped aluminum foil cartridge. The concentrate cartridge is placed on a supporting flange located within the neck of the bottle. A closure cap having a dispensing orifice, a dip tube and an annular row of teeth extending downwardly is provided in the Jeynes Jr. system. The upper surface of the concentrate cartridge is punctured by the annular array of teeth when the closure cap is pressed downwardly thereby releasing the concentrate into the diluent contained in the body of the bottle. The resulting solution is expelled through the dip tube and the dispensing orifice by a squeezing pressure applied to the bottle, which has flexible plastic walls.

The Schwartzman and Smith patents both provide compartments disposed in the bottle neck for holding a powdered component separate from a liquid diluent in the body of the bottle. A plunger means is provided in the closure cap for combining the powdered component and the diluent in response to downward pressure on the plunger. In Schwartzman the plunger operates through a bellows and displaces the bottom wall of the powder compartment while in Smith the plunger forces the entire compartment into the body of the bottle.

The third class employing a reusable container for the diluting fluid and a reusable cartridge for the concentrate is disclosed in U.S. Pat. No. 5,957,335 to Otto and U.S. Pat. No. 6,041,969 to Parise, the entire disclosures of which are hereby incorporated herein by reference. The Otto patent discloses a concentrate cartridge comprised of a circular cylinder having one end open and the opposite end closed by a bellows-like wall. The open end is selectively opened and closed by an annular-shaped wall connected to the bellows-like wall by a hollow actuator tube.

The Parise patent discloses a container for a concentrate including a first hollow cylindrical element having an axial hole in its lower part. A second cylindrically symmetrical element is disposed inside the first element and is comprised of a collar in the shape of an inverted cup which is adapted to slide inside the first element in fluid-tight relationship. A third element in the shape of a ring which threads onto the end of the second element and when tightened forms a single piece with the second element. The external diameter of the ring allows it to slide within the hole in the bottom of the first element with engagement in such a way as to obtain a water-tight fit. The aforementioned collar and the ring effectively close the two opposing ends of the first hollow cylindrical element and defines a chamber for the concentrate. Axial movement of the collar of the second element and the associated ring opens the axial hole in the first element allowing the concentrate to exit the first element into an associated bottle containing a diluting fluid.

It would be desirable to provide a concentrate cartridge which will fit any dispensing container, is simple to install and use, and is recyclable. Further, since the cartridge and container may be utilized to contain fluids which might be dangerous for children as well as adults, it may be desirable to produce a concentrate-containing cartridge and associated diluent-containing container which may not typically be opened by children.

SUMMARY OF THE INVENTION

Consistent and consonant with the present invention, a concentrate cartridge which will fit any dispensing container, is simple to install and use, and is recyclable, has surprisingly been discovered.

In one embodiment, a concentrate cartridge includes a hollow cylindrical element having a chamber formed therein configured to receive a concentrate material therein. The hollow cylindrical element has an upper end and a lower open end. A seal is configured to seal the lower open end of the hollow cylindrical element. A cap configured to be received on the lower open end of the hollow cylindrical element.

In another embodiment, a concentrate cartridge and container assembly includes a container including a body portion for receiving a diluent fluid. The body portion has an opening. A concentrate cartridge has a chamber for receiving a concentrate material therein. The chamber has a closed end and an open end. The open end is coupled to a seal. The concentrate cartridge is removably disposed through the opening of the container. A concentrate cap is removeably coupled to the concentrate cartridge.

In yet another embodiment, a method of diluting a concentrate material with a diluent in a container includes the step of filling a concentrate cartridge with the concentrate material. The concentrate cartridge has a chamber receiving the concentrate material through an open lower end of the concentrate cartridge. Another step includes sealing the open lower end of the concentrate cartridge with a seal to prevent leakage of the concentrate material. Further steps include placing a cap over the seal and the open lower end of the concentrate cartridge; filling a container with the diluent wherein the container has an opening; removing the cap from the concentrate cartridge; inserting the concentrate cartridge through the opening of the container after the step of removing the cap; and releasing the concentrate material from the concentrate cartridge into the container by puncturing the seal.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

The following detailed description and appended drawings describe and illustrate an exemplary embodiment of the present invention. The description and drawings serve to enable one skilled in the art to make and use the invention, and are not intended to limit the scope of the invention in any manner. It is understood that materials other than those described can be used without departing from the scope and spirit of the invention.

As used herein, substantially is defined as "to a considerable degree" or "proximate" or as otherwise understood by one ordinarily skilled in the art. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters. Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section discussed below could be termed a second element, component, region, layer.

Spatially relative terms, such as "front," "back," "inner," "outer," "bottom," "top," "horizontal," "vertical," "upper," "lower," "side," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

Figure 1:
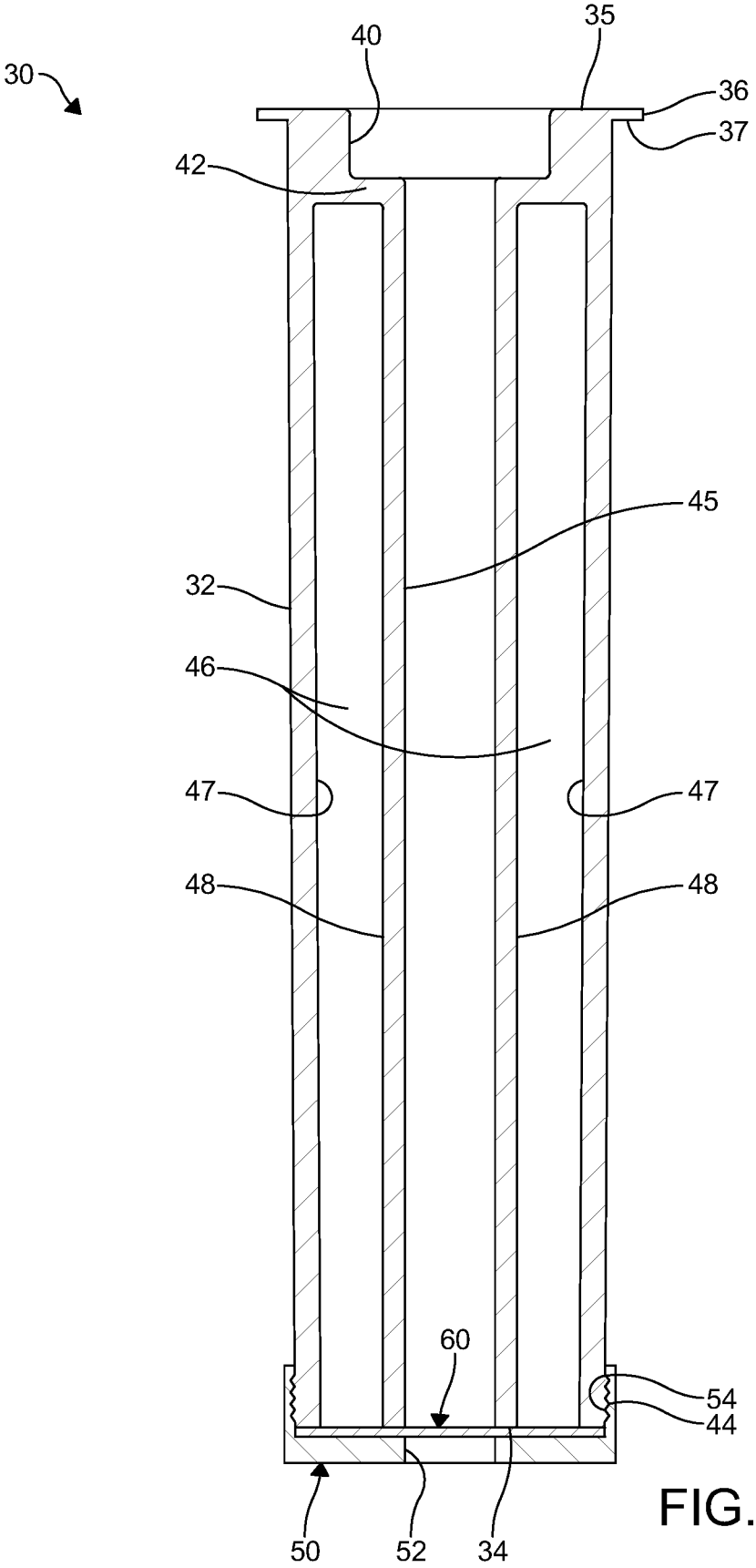
FIG. 1 illustrates a front cross-sectional elevational view of a concentrate cartridge according to an embodiment of the disclosure, wherein the cross-section is taken along a line through a central axis extending along a length of the concentrate cartridge.
Figure 2:
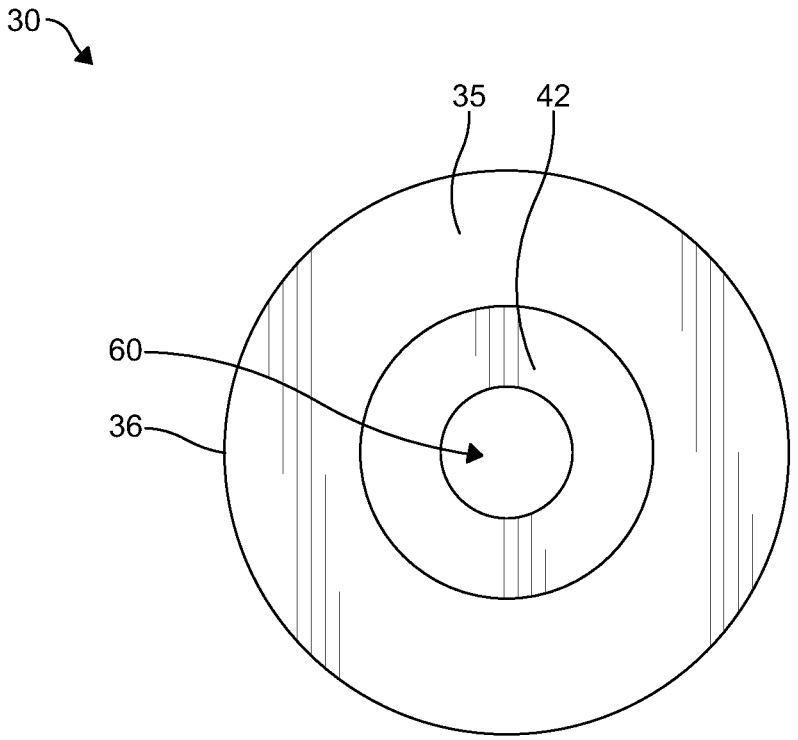
FIG. 2 is a top plan view of the concentrate cartridge of FIG. 1.
Figure 3:
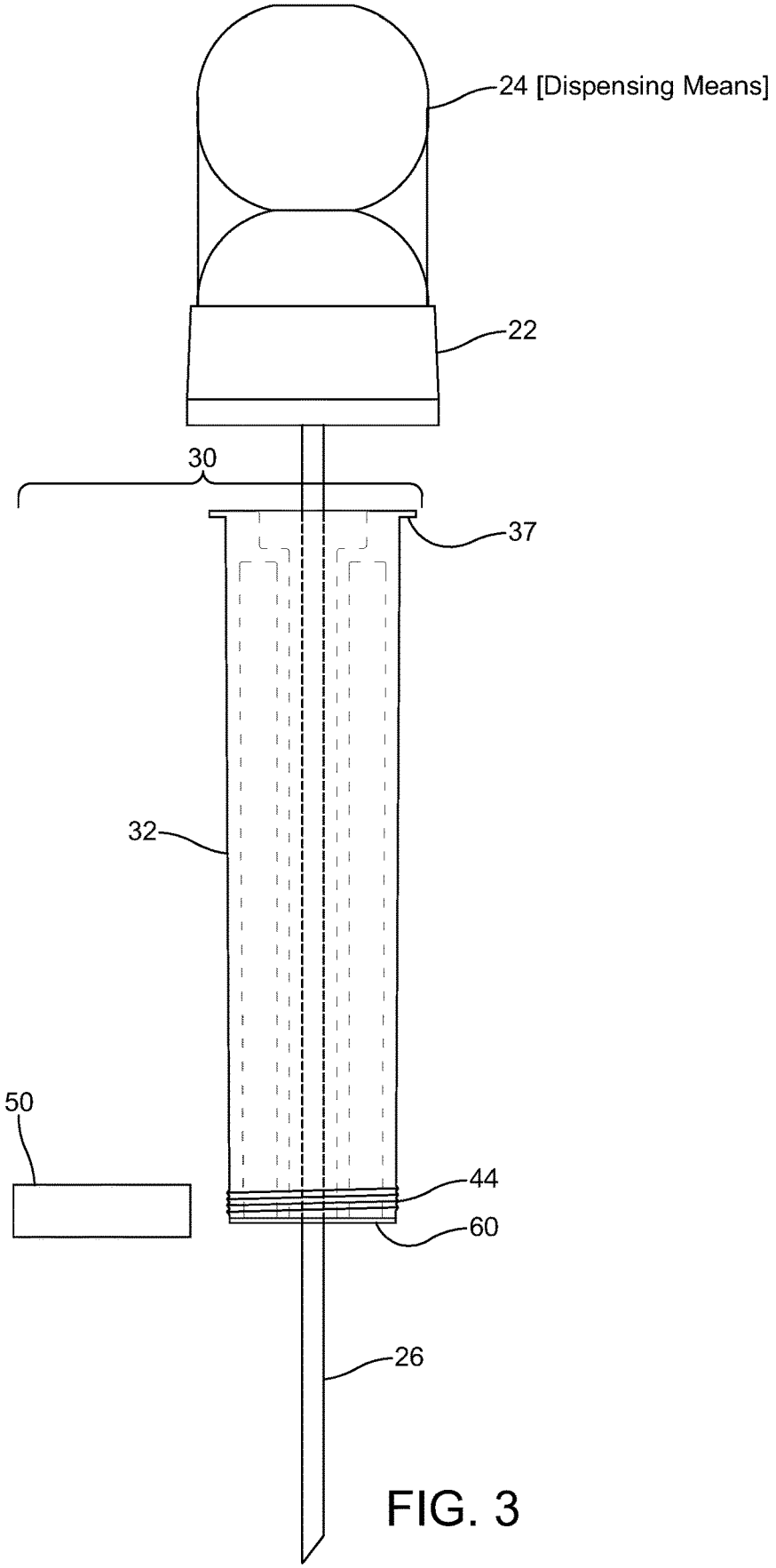
FIG. 3 is an exploded front elevational view of the concentrate cartridge of FIGS. 1-2, a dispensing means and a closure cap of a container, wherein internal features of the concentrate cartridges are shown in hidden lines and a dip tube extending through the concentrate cartridge is shown in dashed lines.
Figure 4:
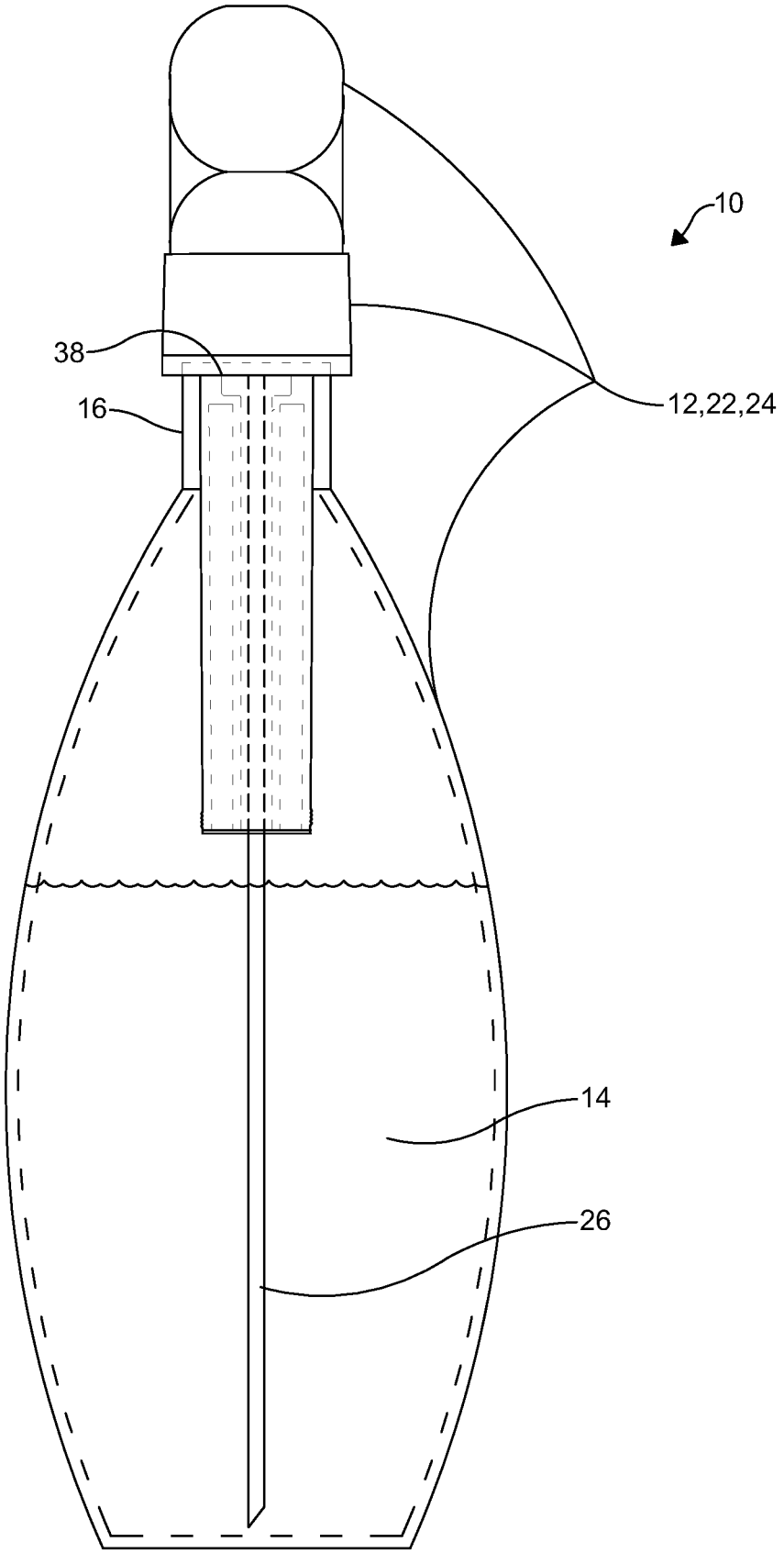
FIG. 4 is an assembled front elevational view of the concentrate cartridge of FIGS. 1-3 coupled to the dispensing means and the container.

FIGS. 1-4 illustrate a container 10 for diluting and dispensing a concentrated material. The container 10 includes a body portion 12 including a closed base for containing a diluent fluid 14 such as water, for example, and a hollow neck portion 16. The container 10 may be produced from any conventional material known in the art such as high-density polyethylene, for example. Although, it is appreciated in the art, other materials such as polyethylene terephthalate, other polymers, metals, paper, glass, or similar materials commonly known for containing commercial fluids could be contemplated. Additionally, the body portion 12 of the container 10 is illustrated as transparent or clear. However, it is understood, the body portion 12 can be formed as a non-transparent structure or material.

The neck portion 16 is typically provided with external threads (not shown) formed on an outer surface thereof for engaging cooperating internal threads (not shown) formed on an inner surface of an associated closure cap 22. Other mating means may be used such as a press fit, for example. The neck portion 16 has a substantially circular cross-section. The closure cap 22 is configured to form a seal at an open end of the neck portion 16 of the container 10. As shown, the closure cap 22 is coupled to a dispensing means 24. The dispensing means 24 includes a depending dip tube 26. For example, the dispensing means 24 in configured as a trigger sprayer. However, other dispensing means can be contemplated as desired such as other types of automatic or manual pumps, for example.

A concentrate cartridge 30 is configured to be received in the body portion 12 of the container 10 through the neck portion 16. Although a substantially circular cross-sectional shape is shown, it is understood that other cross-sectional shapes can be used for the cartridge 30 such as a rectangular cross-sectional shape, for example. In the embodiment shown, the cartridge 30 is produced from a recyclable material. Favorable results have been obtained using a 100 percent recyclable material. The cartridge 30 may be produced from any conventional materials known in the art such as high-density polyethylene, for example. Other examples include other various polymers, glass, metals, or combinations thereof.

The cartridge 30 has an outer diameter slightly smaller than an inside diameter of the neck portion 16 and is configured to be received in the neck portion 16. The cartridge 30 includes a main hollow cylindrical element 32 defined by an inner wall 48 and an outer wall 47. A lower end 34 of the hollow cylindrical element 32 is open. An upper end 35 is provided with a radially outwardly extending annular flange 36, which, as shown, extends completely around an outer peripheral surface of the hollow cylindrical element 32. An under surface 37 of the flange 36 is configured to rest on an upper open end 38 of the neck portion 16 of the container 10. The under surface of the flange 36 is generally flat and supports the cartridge 30 within the neck portion 16 of the container 10. The upper end 35 of the cartridge 30 includes an annular collar 40 adjacent the flange 36. The annular collar 40 is interconnected to the inner wall 48 and the outer wall 47 of the hollow cylindrical element 32 by an annular web 42. In the embodiment shown, threads 44 are formed on the cartridge 30 adjacent the lower end 34. A chamber 46 is formed between the outer wall 47 and the inner wall 48 of the cartridge 30. The chamber 46 is open adjacent the lower end 34 of the cartridge 30 and is configured to store the concentrated material therein. A cavity 45 is defined by the inner wall 48 and is configured to receive the dip tube 26 therethrough.

The cartridge 30 includes an associated cap or closure member 50. A closed end of the cap 50 is disc shaped and has a central aperture 52 formed therein configured to receive the dip tube 26 therethrough. The cap 50 is configured to be received on the lower end 34 of the cartridge 30 to sealingly close the open lower end 34 thereof. Threads 54 are formed on an inner surface of the cap 50 and are configured to mate with the threads 44 of the cartridge 30. If desired, the threads 44, 54 of the cartridge 30 and the cap 50 may be made childproof or child resistant as is known in the art. Further, it is understood that other methods of joining the cap 50 to the cartridge 30 may be used as desired such as press fitting, heat welding, an adhesive, or other method as desired. As shown, the cap 50 is produced from a recyclable material, and may be produced from the same material as the cartridge 30.

A seal or liner 60 is interposed between the cartridge 30 and the cap 50. The seal 60 may include an adhesive or other joining means on one side thereof to bond the seal to the lower end 34 of the cartridge 30. An induction seal may also be used to join the seal 60 with the cartridge 30. As shown, the seal 60 is produced from a recyclable material such as foil, plastic, or other conventional material. It is desirable that the seal 60 be selected from a material and sized such that the seal 60 may be punctured by the dip tube 26 upon assembly of the cartridge with the container 10 and closure cap 22. In other words, the seal 60 is perforable. As used herein, "perforable means the seal 60 is capable of being penetrated to form a hole therethrough or separated from the cartridge 30 after being bonded thereto. In the present example, the seal 60 may be holed or broken such that the concentrate material is released from the chamber 46.

The cartridge 30 is assembled by providing the hollow cylindrical element 32. The hollow cylindrical element 32 is then filled with the concentrate material through the open lower end 34 of the hollow cylindrical element 32. It is understood the concentrate material can be a fluid, a powder, granules, and the like as desired. The seal 60 is then placed over the lower end 34 of the cartridge 30. If an adhesive is disposed on the seal 60, the adhesive will bond with the cartridge 30. The cap 50 is then joined with the lower end 34 of the cartridge 30 to cooperate with the seal 60 to create a fluid tight seal with the cartridge 30. The cartridge 30 can then be sold to consumers or end users.

When it is desired to use the cartridge 30, the end user fills the container 10 with the diluent fluid 14 to a desired level within the container 10. The user then removes the cap 50 from the cartridge 30 and places the cartridge 30 within the hollow neck portion 16 of the container 10 such that the flange 36 of the cartridge 30 rests on the hollow neck portion 16. The assembled closure cap 22 and dispensing means 24 is then inserted into the container 10. Forces from the cap 22 and the neck portion 16 engaging each other acts on the flange 36 to stabilize the cartridge 30 within the container 10. The dip tube 26 of the dispensing means 24 punctures the seal 60 and the concentrate material empties into the diluent fluid 14 and mixes therewith in the container 10. The user may now use the combined concentrate material and the diluent fluid 14 for its intended purpose. Once the combined concentrate material and diluent fluid 14 is completely used, the user may remove the assembled closure cap 22 and dispensing means 24 and remove the cartridge 30 for recycling. A new cartridge 30 may then be assembled with the container 10 by repeating the procedure as described hereinabove.

The cartridge 30 may be used with any type of sprayer or bottle as desired. Further, the cartridge 30 is environmentally friendly since the materials of construction are recyclable. Waste is also minimized since the container 10 can be reused over and over. Shipping space and costs are minimized due to the compact nature of the cartridge 30. Retailers also save shelf space since only the cartridge 30 needs to be sold instead of the entire container 10 and dispensing means 24.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A concentrate cartridge comprising:

a hollow cylindrical element having a chamber formed therein configured to receive a concentrate material therein, the hollow cylindrical element having an upper end and a lower open end;

a seal configured to seal the lower open end of the hollow cylindrical element, wherein the hollow cylindrical element is configured to receive a dip tube therethrough and to facilitate puncturing of the seal by the dip tube; and a cap configured to be received on the lower open end of the hollow cylindrical element.

2. The concentrate cartridge of claim 1, wherein the hollow cylindrical element includes a cavity formed therethrough for receiving the dip tube.

3. The concentrate cartridge of claim 2, wherein the hollow cylindrical element includes an inner wall and an outer wall defining the chamber therebetween, the chamber is closed proximate the upper end of the hollow cylindrical element.

4. The concentrate cartridge of claim 3, wherein the inner wall defines the cavity.

5. The concentrate cartridge of claim 3, wherein the upper end of the hollow cylindrical element includes a flange.

6. The concentrate cartridge of claim 5, wherein the flange extends radially outwardly completely around an outer peripheral surface of the hollow cylindrical element.

7. The concentrate cartridge of claim 5, wherein the upper end of the hollow cylindrical element includes an annular collar adjacent the flange.

8. The concentrate cartridge of claim 7, wherein the annular collar is interconnected to the inner wall and the outer wall of the hollow cylindrical element by an annular web.

9. The concentrate cartridge of claim 1, wherein the cap includes threads on an inner surface thereof and the hollow cylindrical element includes threads formed on an outer surface thereof for engaging the threads of the cap.

10. The concentrate cartridge of claim 1, wherein the hollow cylindrical element, the seal, and the cap are produced from recyclable materials.

11. The concentrate cartridge of claim 1, wherein the hollow cylindrical element is formed from a high-density polyethylene.

12. The concentrate cartridge of claim 1, wherein the seal is coupled to the lower end of the hollow cylindrical element with an adhesive.

13. The concentrate cartridge of claim 1, wherein an induction seal is used to couple the seal to the lower end of the hollow cylindrical element.

14. A concentrate cartridge and container assembly comprising:

a container including a body portion for receiving a diluent fluid, the body portion having an opening; and a concentrate cartridge having a chamber for receiving a concentrate material therein, the chamber having a closed end and an open end, the open end coupled to a seal, the concentrate cartridge removably disposed through the opening of the container, a concentrate cap removably coupled to the concentrate cartridge, wherein the seal is perforable through a cavity formed in the concentrate cartridge by a dispensing means to open the seal, and wherein the cavity is separated from the chamber by a wall.

15. The concentrate cartridge and container assembly of claim 14, further including a container cap coupled to the open end of the body portion, the container cap cooperating with the body portion to stabilize the concentrate cartridge therebetween.

16. The concentrate cartridge and container assembly of claim 14, wherein the concentrate cartridge includes a flange configured to engage the open end of the body portion of the container about the opening.

17. A method of diluting a concentrate material with a diluent in a container comprising the steps of:

filling a concentrate cartridge with the concentrate material, the concentrate cartridge having a chamber receiving the concentrate material through an open lower end of the concentrate cartridge;

sealing the open lower end of the concentrate cartridge with a seal to prevent leakage of the concentrate material;

placing a cap over the seal and the open lower end of the concentrate cartridge;

filling a container with the diluent, the container having an opening;

removing the cap from the concentrate cartridge;

inserting the concentrate cartridge through the opening of the container after the step of removing the cap; and releasing the concentrate material from the concentrate cartridge into the container by puncturing the seal.

* * * * *